US011219327B2

(12) United States Patent
Chan

(10) Patent No.: US 11,219,327 B2
(45) Date of Patent: Jan. 11, 2022

(54) STACKABLE HANGER

(71) Applicant: Uniplast Industries, Inc., Hasbrouk Heights, NJ (US)

(72) Inventor: King Keung Kennedy Chan, Pokfulam (HK)

(73) Assignee: UNIPLAST INDUSTRIES, INC., Hasbrouck Heights, NJ (US)

( * ) Notice: Subject to any disclaimer, the term of this patent is extended or adjusted under 35 U.S.C. 154(b) by 118 days.

(21) Appl. No.: 16/707,980

(22) Filed: Dec. 9, 2019

(65) Prior Publication Data

US 2021/0169255 A1 Jun. 10, 2021

(51) Int. Cl.
*A47G 25/14* (2006.01)
*A47G 25/48* (2006.01)

(52) U.S. Cl.
CPC ..... *A47G 25/1442* (2013.01); *A47G 25/48* (2013.01)

(58) Field of Classification Search
CPC .... A47G 25/1442; A47G 25/48; A47G 25/02; A47G 25/0607; A47G 25/14; A47G 25/1407; A47G 25/1428; A47G 25/1435; A47G 25/28; A47G 25/34; A47G 25/36; A47G 25/483; A47G 25/484; A47G 25/50
USPC ..... D08/367, 371
See application file for complete search history.

(56) References Cited

U.S. PATENT DOCUMENTS 537,120 A * 4/1895 Leib ..... A47G 25/1435 223/85
4,346,825 A * 8/1982 Leger ..... A47G 25/28 211/113
D367,574 S * 3/1996 Werner ..... D6/514
6,019,260 A * 2/2000 Gouldson ..... A47G 25/1435 223/85
6,050,461 A * 4/2000 Batts ..... A47G 25/1442 223/85
D476,815 S * 7/2003 Richter ..... A47G 25/28 D3/328
6,705,496 B2 * 3/2004 Marshall ..... G09F 3/20 223/85
D723,845 S * 3/2015 Valiulis ..... G09F 3/20 D6/682.4
D827,315 S 9/2018 Taylor et al.
D834,338 S * 11/2018 Taylor ..... D6/323
2007/0194063 A1 * 8/2007 Wu ..... A47G 25/186 223/85

FOREIGN PATENT DOCUMENTS

CH 695132 A5 * 12/2005
GB 2136684 A * 9/1984

* cited by examiner

*Primary Examiner* — Ismael Izaguirre
(74) *Attorney, Agent, or Firm* — Leason Ellis LLP

(57) ABSTRACT

A stackable hanger includes a main body having a hook portion; and a clip portion that extends downwardly from the main body and includes an opening defined by a bottom edge of the main body, first and second side walls, and a connector wall that connects and extends between bottom ends of the first and second side walls. The clip portion has a flexible clip that protrudes outwardly from the connector wall and has an angled wall that overlies at least a portion of the opening and is configured to flex outwardly away from the first and second side walls.

18 Claims, 6 Drawing Sheets

STACKABLE HANGER

TECHNICAL FIELD

The present invention relates to a garment hanger and more particularly, to a stackable garment hanger that is configured to hold a pair of pants, such as jeans.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they, also come in a number of different styles that have different types of constructions to accommodate different articles that are carried by the hangers.

For example, one type of garment, hanger construction is designed to secure knitwear, blouses, slips, strapped garments, including dresses and lingerie, Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

Hangers are typically manufactured at a factory and then shipped to a customer which can be a retail store or the like that then places the articles, such as clothing, on the hangers. Since most hangers are formed of molded plastics and there is pressure to maintain margins and this includes managing shipping costs which can fluctuate due to energy costs and other factors, etc. Hangers are shipped most often by packaging together a number of hangers into a box and then shipping. Therefore, there is a desire to pack as many hangers into a single box to reduce shipping costs. The present disclosure provides a solution to this objective.

SUMMARY

In one embodiment, a stackable hanger is provided and includes a main body having a hook portion; and a clip portion that extends downwardly from the main body and includes an opening defined by a bottom edge of the main body, first and second side walls, and a connector wall that connects and extends between bottom ends of the first and second side walls. The clip portion has a flexible clip that protrudes outwardly from the connector wall and has an angled wall that overlies at least a portion of the opening and is configured to flex outwardly away from the first and second side walls.

In another aspect, a nested hanger arrangement is provided and includes two or more hangers. Each hanger includes a main body having a hook portion; and a clip portion that extends downwardly from the main body and includes an opening defined by a bottom edge of the main body, first and second side walls, and a connector wall that connects and extends between bottom ends of the first and second side walls. The clip portion has a flexible clip that protrudes outwardly from the connector wall and has an angled wall that overlies at least a portion of the opening and is configured to flex outwardly away from the first and second side walls. In a stacked condition, the two or more hangers are nested with respect to one another with flexible clip of one of the two or more hangers is received within the opening of another of the two or more hangers with the flexible clips of the two or more hangers seating against one another.

BRIEF DESCRIPTION OF THE DRAWING FIGURES

DETAILED DESCRIPTION OF CERTAIN EMBODIMENTS

Figure 1:
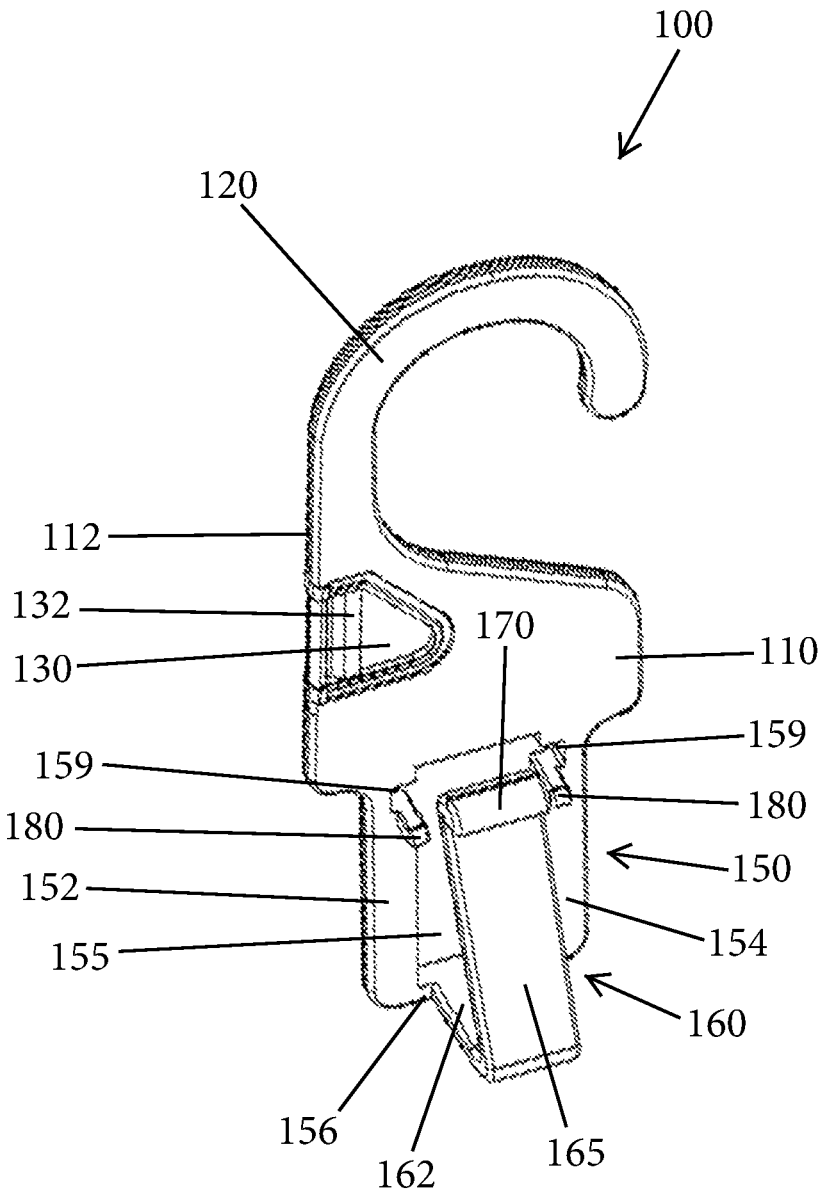
FIG. 1 is a front perspective view of a hanger in accordance with one embodiment.
Figure 2:
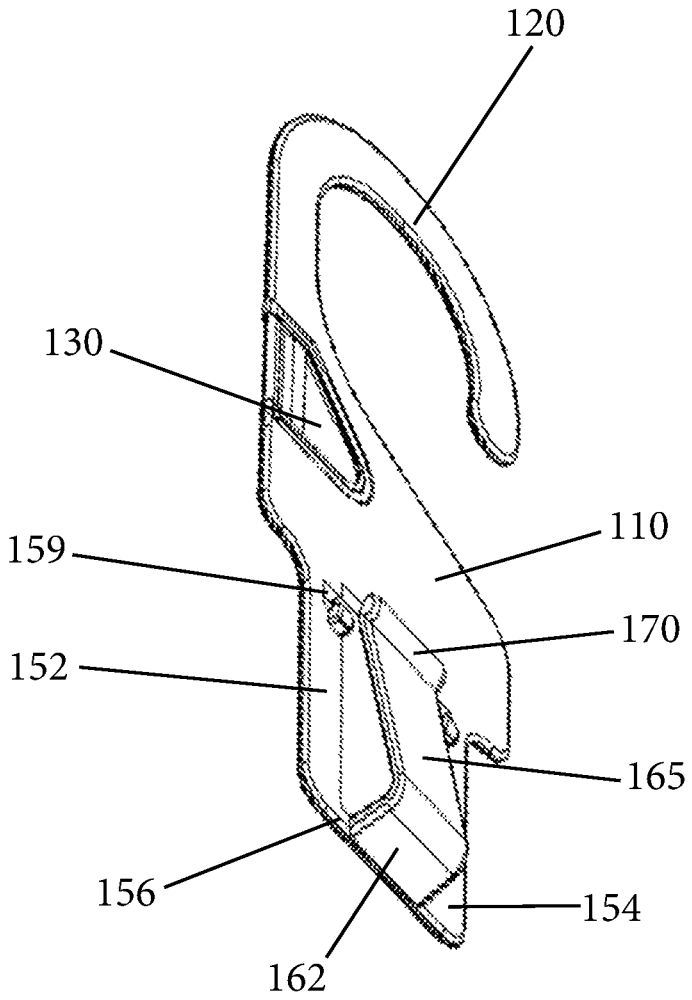
FIG. 2 is a side and bottom perspective view of the hanger.
Figure 3:
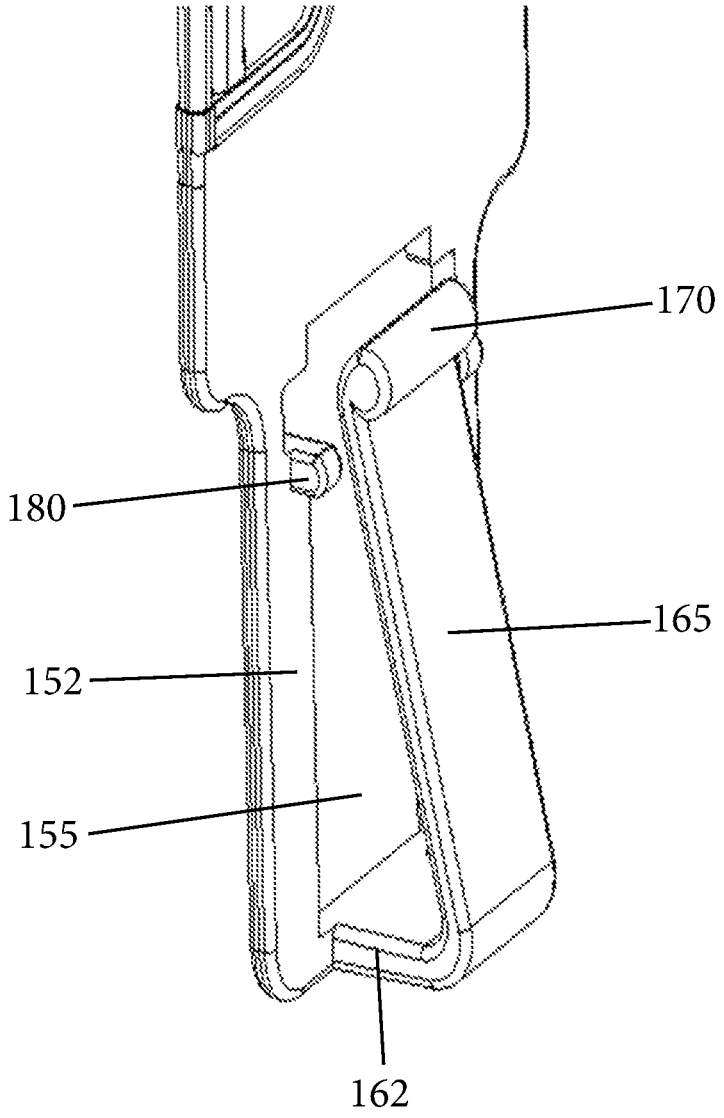
FIG. 3 is a close-up perspective front view of a clip portion of the hanger.
Figure 4:
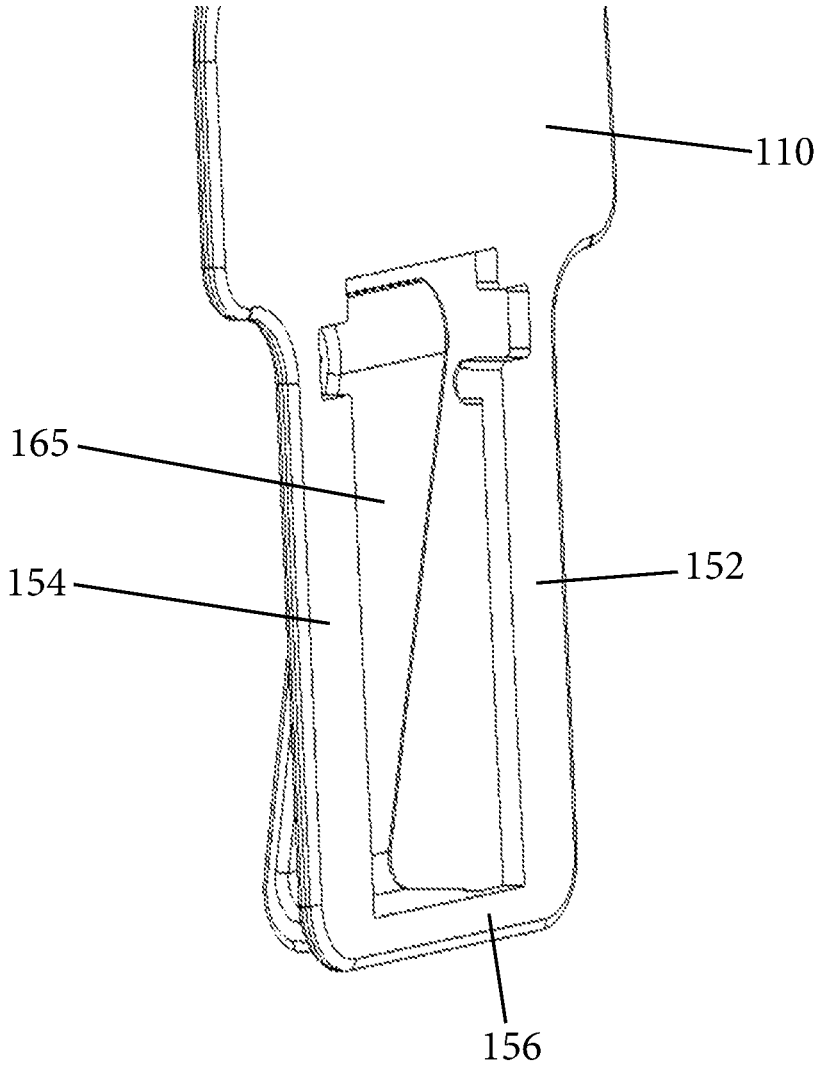
FIG. 4 is a close-up perspective rear view of the clip portion.
Figure 5:
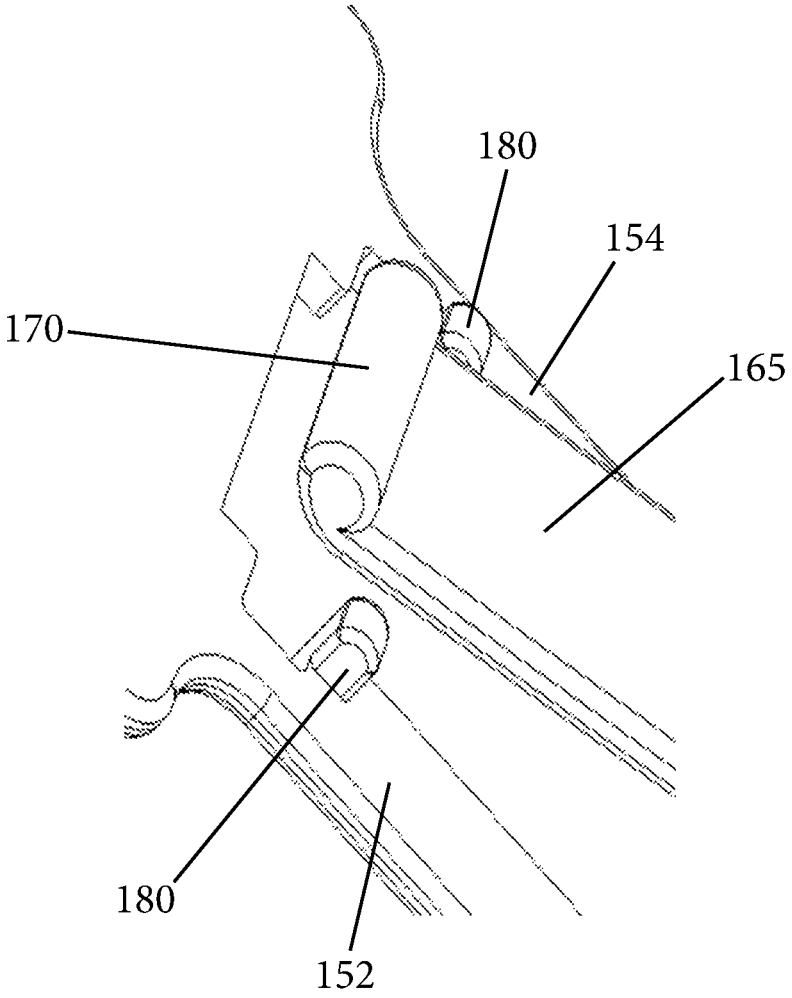
FIG. 5 is a close-up perspective view of a free distal end of a flexible clip.

FIGS. 1-8 illustrate a hanger 100 that includes a main body 110 that includes a hook portion 120. The hook portion 120 extends upward from a top edge of the main body 110. The main body 110 also includes a first side (side edge) 112 that defines one side edge of the hook portion 120 as well. Also, along the first side 112, there is a recessed area 130 that is configured to receive a size indicator that is not shown. Size indicators are well known and include size indicia formed thereon to identify the size of the article that is attached to the hanger 100. The recessed area 130 includes at least one locking ridge 132 that mates with the size indicator for locking the size indicator in place.

The hanger 100 also includes a clip portion 150 that extends downwardly from a bottom edge of the main body 110. The clip portion 150 is defined by a rigid first side wall 152 and a rigid second side wall 154 that is spaced from the rigid first side wall 152 with an opening 155 being formed therebetween. The opening 155 has a non-uniform shape in that the top end of the opening 155 is enlarged relative to the middle and bottom end of the opening 155. More specifically, the enlarged top end is defined by a pair of slots (through holes) 159 that extend outwardly from the main opening 155 so as to give the overall opening 155 a T shape. The top end itself of the opening 155 has the same width as the middle and bottom end of the opening 155. In other words, the opening 155 can be rectangular shaped with a common diameter except for the slots 159 which extend outwardly and define an area of maximum width of the opening. The first and second side walls 152, 154 are parallel to one another. A connecting wall 156 extends between the bottom ends of the first and second side walls 152, 154 and itself defines a bottom of the opening 155.

The clip portion 150 has a flexible clip 160 that is fixedly attached to one face of the connecting wall 156. The flexible clip 160 has a first wall 162 that comprises the wall that is fixedly attached to the connecting wall 156 and can be formed perpendicular to the connecting wall 156. The first wall 162 thus lies adjacent the connecting wall 156 and at the bottom end of the opening 155.

The flexible clip 160 also has a second wall 165 that is an angled wall that is angled relative to the first wall 162. More particularly, the second wall 165 is formed at the end of the first wall 162 opposite the connection between the first wall 162 and the connecting wall 156. The second wall 165 is angled such that it is directed from the first wall 162 toward the opening 155. The interface between the first and second walls 162, 165 can comprise a curved transition from one wall to the other wall. The second wall 165 can be smooth and flat with the exception of the free distal end which is described below. In a rest position, the second wall 165 is not disposed within the opening 155 but instead is located adjacent thereto. However, then the clip 160 is flexed, it can move into the opening 155.

As mentioned previously, the free distal end of the clip 160 has a ridge or protrusion 170 that extends across a width of the second wall 165. The ridge 170 can thus be a linear shaped protrusion that is formed along the exterior face of the second wall 165 that faces away from the opening 155. The ridge 170 can be formed to have a rounded surface. As shown in the at rest position of FIG. 7, the ridge 170 is located adjacent the enlarged top end of the opening 155.

The hanger 100 can also include a pair of posts or protrusions 180 that are formed along the first and second side walls 152, 154 and extend outwardly from surfaces of the side walls that face the flexible clip 160. The posts 180 can take any number of different shapes including square shaped as shown. The posts 180 are formed along the side walls 152, 154 at a location that is adjacent the enlarged top end of the opening 155. In the at rest position, the distal end and the ridge 170 of the flexible clip 160 lie in a first transverse plane that is parallel but above a second transverse plane that passes through and contains the posts 180. This arrangement results since the distal end of the flexible clip 160 is disposed within the enlarged top end of the opening 155.

Posts 180 are provided for preventing the jeans to come out when it is laid flat in the carton box during transportation.

Figure 8:
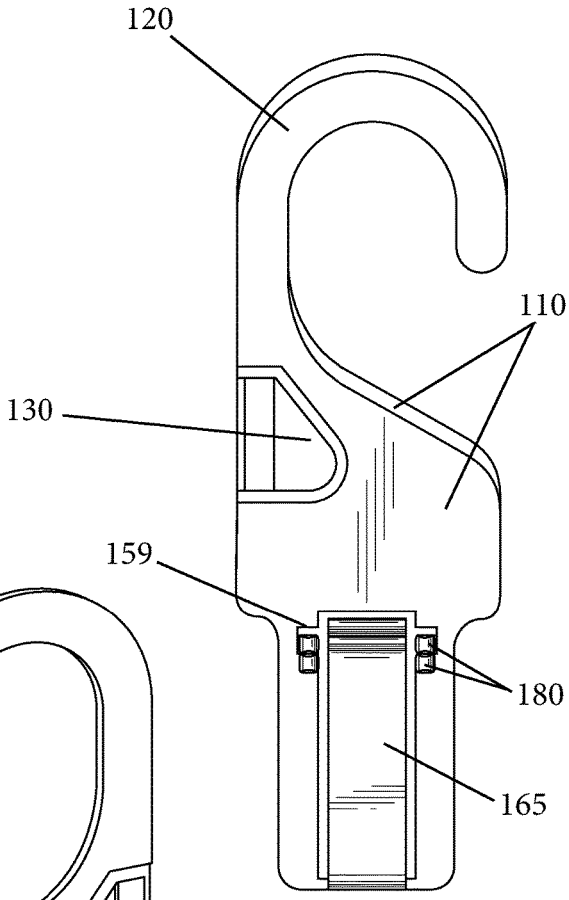
FIG. 8 is a rear elevation view of the two hangers stacked.
Figure 6:
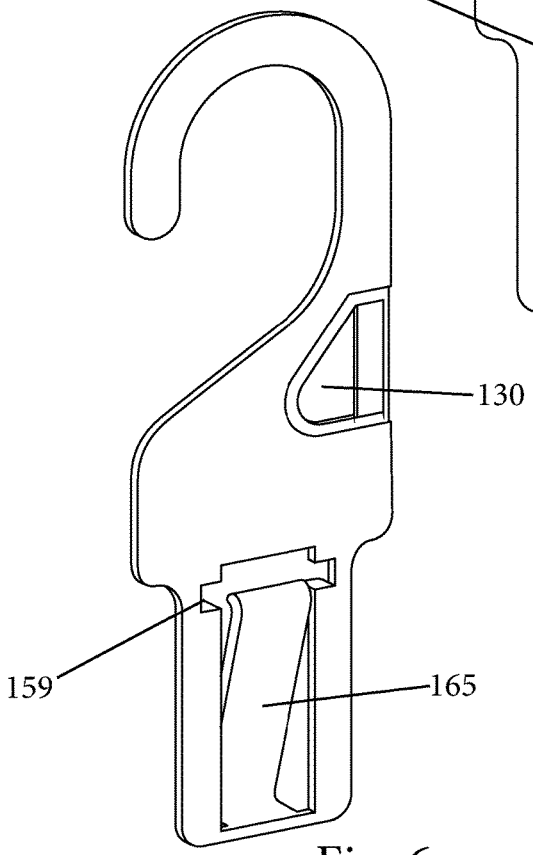
FIG. 6 is a rear perspective view of the hanger.

As shown in more detail in FIG. 8, the posts 180 can be formed to have a curved construction that can be almost semi-circular in shape in that the surface of the post 180 slopes immediately as it travels away from the first and second side walls 152, 154. The sloped nature of the posts 180 allow the jeans to be more easily put in and pulled out. The other figures of the present application disclose that the posts 180 can be constructed so that the curvature is located at the distal end. In other words, the post 180 initially extends from wall 152, 154 in a non-curved manner (i.e., at 90 degrees) and then as curvature at its distal end.

The article of clothing is held using the hanger 100 in the following manner. The flexible clip 160 is pulled outward to increase the space between the flexible clip 160 and the first and second side walls 152, 154 so as to allow insertion of one of the pant loops over free end of the flexible clip 160. After insertion, the pant loop seats against the first wall 162 of the flexible clip 160, thereby allow the pant (article of clothing) to be hung with hanger 100. The width of the first wall 162 is thus sized to allow the pant loop to seat thereagainst.

Stackability of Hangers 100

The hangers 100 are designed to be easily stacked in a compact manner which allows a greater number of hangers 100 to be packaged within a box or the like. This directly results in reduced shipping costs since more hangers 100 can be contained within a single package (box).

Figure 7:
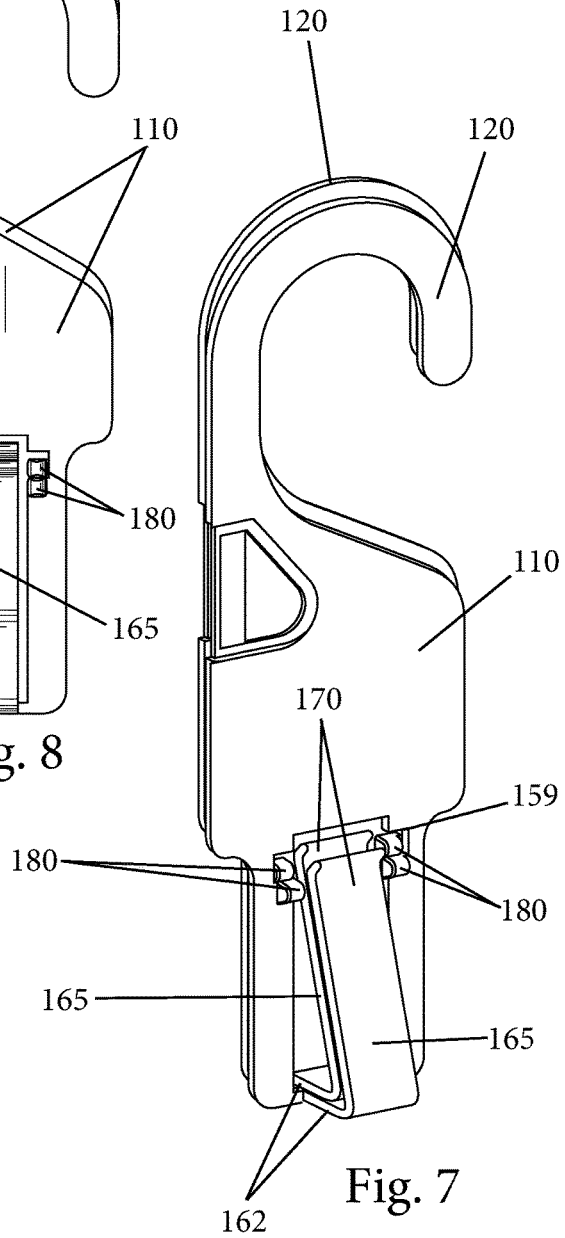
FIG. 7 is a front perspective view of two hangers stacked.

FIGS. 7-8 show the stacking of a plurality of hangers 100. The hangers 100 are stacked on top of one another. Since the hangers 100 can be stacked flush to one another, the hanger stack is compact.

In the stacked position, the main bodies 110, including the hook portions 120, of the hangers 100 are flat and seat at least substantially flush against one another. Similarly, the flat first and second side walls 152, 154 seat generally flush against one another. The opening 155 is sized so as to receive the flexible clip 160 of an underlying hanger 100. In this way, the outward projecting first wall 162 of the flexible clip 160 is received within and passes through the opening 155 of one or more hangers 100 that are stacked above this particular hanger 100. The hanger 100 that is immediately above is positioned such that the first wall 162 lies adjacent but outside (to the exterior) of the first wall 162 of the flexible clip 160 that is associated with the hanger 100 that lies below. The angled second walls 165 seat against one another in a flush manner since the bottom faces of the angled second walls 165 are flat. In addition, in the stacked position, the free distal end of the flexible clip 160 seats against the ridge 170 of the underlying hanger 100.

In the stacked position, as shown, the posts 180 of the underlying hanger 100 are received within the slots 159 of the hanger 100 that is located above. The posts 180 thus act not only as a guide but also serve as coupling members that position and retain the stacked hangers 100 in place.

Accordingly, despite having an outwardly extending flexible clip 160, the hangers 100 are configured so that they can nest (stack) together to form a compact stack of hangers 100 that can easily be placed into a package (e.g., box) or the like.

What is claimed is:

1. A stackable hanger comprising:

a main body having a hook portion; and a clip portion that extends downwardly from the main body and includes an opening defined by a bottom edge of the main body, first and second side walls, and a connector wall that connects and extends between bottom ends of the first and second side walls, the clip portion having a flexible clip that protrudes outwardly from the connector wall and has an angled wall that overlies at least a portion of the opening and is configured to flex outwardly away from the first and second side walls;

wherein the opening has a pair of side slots extending outwardly from the opening so as to define a localized widening of the opening.

2. The stackable hanger of claim 1, wherein the first and second side walls are parallel to one another.

3. The stackable hanger of claim 2, wherein the connector wall is formed at a right angle to each of the first side wall and the second side wall.

4. The stackable hanger of claim 1, wherein the flexible clip has a first wall that is integral to and extends outwardly from the connector wall and an angled wall that slopes from the first wall toward to the opening.

5. The stackable hanger of claim 4, wherein the first wall is formed at a right angle relative to the connector wall and the angled wall is formed at an angle other than 90 degrees relative to the first wall.

6. The stackable hanger of claim 1, further including a pair of posts that extend outwardly from the first and second side walls alongside the opening.

7. The stackable hanger of claim 6, wherein the pair of posts are located adjacent the pair of slots.

8. The stackable hanger of claim 1, wherein the flexible clip has a raised ridge formed at a free distal end thereof and formed so as to extend across a width of the flexible clip.

9. The stackable hanger of claim 1, wherein the hanger is formed as a single molded part.

10. The stackable hanger of claim 1 wherein the main body includes a recessed locking area for receiving and locking to a top sizer indicator.

11. A nested hanger arrangement comprising:

two or more hangers, each hanger comprising a main body having a hook portion; and a clip portion that extends downwardly from the main body and includes an opening defined by a bottom edge of the main body, first and second side walls, and a connector wall that connects and extends between bottom ends of the first and second side walls, the clip portion having a flexible clip that protrudes outwardly from the connector wall and has an angled wall that overlies at least a portion of the opening and is configured to flex outwardly away from the first and second side walls;

wherein in a stacked condition, the two or more hangers are nested with respect to one another with flexible clip of one of the two or more hangers is received within the opening of another of the two or more hangers with the flexible clips of the two or more hangers seating against one another.

12. The nested hanger arrangement of claim 11, wherein each flexible clip has a first wall that is integral to and extends outwardly from the connector wall and an angled wall that slopes from the first wall toward to the opening and wherein in the stacked condition, the first walls of the flexible clips of the two or more hangers are disposed adjacent one another.

13. The nested hanger arrangement of claim 12, wherein the first wall is formed at a right angle relative to the connector wall and the angled wall is formed at an angle other than 90 degrees relative to the first wall.

14. The nested hanger arrangement of claim 11, wherein the opening of each hanger has a pair of side slots extending outwardly from the opening so as to define a localized widening of the opening.

15. The nested hanger arrangement of claim 14, further including a pair of posts that extend outwardly from the first and second side walls alongside the opening.

16. The nested hanger arrangement of claim 15, wherein the pair of posts are located adjacent the pair of slots.

17. The nested hanger arrangement of claim 11, wherein the flexible clip has a raised ridge formed at a free distal end thereof and formed so as to extend across a width of the flexible clip, wherein in the stacked condition, the raised ridges of the two or more hangers are adjacent one another.

18. A nested hanger arrangement comprising:

two or more hangers, each hanger comprising a main body having a hook portion; and a clip portion that extends downwardly from the main body and has an opening formed therein, the opening having a pair of side slots extending outwardly from the opening so as to define a localized widening of the opening, the clip portion having a flexible clip that overlies at least a portion of the opening, the clip portion including a pair of posts that protrude outwardly and are located alongside the opening;

wherein in a stacked condition, the two or more hangers are nested with respect to one another with the pair of posts of one hanger of the two or more hangers being received within the pair of side slots of another hanger of the two or more hangers and the flexible clip of the one hanger of the two or more hangers being received within the opening of the other hanger of the two or more hangers.

* * * * *